United States Patent [19]

Thedford

[11] 4,123,855

[45] Nov. 7, 1978

[54] FLUID FILLED INSOLE

[76] Inventor: Shirley C. Thedford, P.O. Box 5052, Richardson, Tex. 75080

[21] Appl. No.: 823,349

[22] Filed: Aug. 10, 1977

[51] Int. Cl.[2] ..... A43B 13/40; A43B 7/08

[52] U.S. Cl. ..... 36/44; 36/3 B; 36/29; 128/594

[58] Field of Search ..... 36/44, 29, 3 B, 71; 128/594, 595

[56] References Cited

U.S. PATENT DOCUMENTS

| | | | |
|---|---|---|---|
| 1,453,394 | 5/1923 | Klepac | 36/3 B |
| 1,504,908 | 8/1924 | Sato | 36/3 B |
| 1,653,059 | 12/1927 | Nelson | 36/29 |
| 1,869,257 | 7/1932 | Hitzler | 36/29 X |
| 2,080,469 | 5/1937 | Gilbert | 36/29 |
| 2,086,389 | 7/1937 | Pearson | 128/594 |
| 3,120,712 | 2/1964 | Menken | 36/29 |
| 3,724,106 | 4/1973 | Magidson | 36/44 |
| 3,795,994 | 3/1974 | Ava | 36/29 |
| 3,914,881 | 10/1975 | Striegel | 36/44 |

*Primary Examiner*—James Kee Chi

*Attorney, Agent, or Firm*—Hubbard, Thurman, Turner, Tucker & Glaser

[57] ABSTRACT

An improved fluid filled insole is disclosed. One aspect of the improvement is the inclusion of openings to provide ventilation and to control flow of the fluid. The insole is formed of two superimposed sheets of flexible, fluid impervious material sealed together at selected sites to form an enclosure between the sheets capable of holding a fluid. Embodiments are disclosed wherein the openings lie on a transverse line underlying the ball of the foot, on a longitudinal line underlying the longitudinal arch of the foot, and on a transverse line underlying the heel. Another aspect of the improvement is the use of foam material enclosed between the sheets.

13 Claims, 13 Drawing Figures

FLUID FILLED INSOLE

BACKGROUND OF THE INVENTION

This invention relates to a fluid filled insole.

An insole worn in a shoe can be a source of comfort to the wearer. The common form, fashioned of foam material provides a surface for the foot to push against that is more resilient than the normal inner surface of a shoe sole. In addition, the insole is a replaceable element which covers wrinkles that might form in the inner surface of the shoe sole.

A fluid filled insole is capable of providing even more comfortable wear because of the particular distribution of support produced by a fluid. In addition, the structure of the insole can permit the fluid to flow back and forth in a controlled fashion during walking so as to produce a massaging action on the foot.

Unfortunately, existing fluid filled insoles have several shortcomings. The insoles are usually made of vinyl; as a result, the feet of the wearer have a tendency to get hot from the insoles. In addition, the flow of the fluid during walking is not optimal. There are barriers in the insole which prevent the flow of fluid in certain directions, but in spaces between the barriers, the fluid moves somewhat too swiftly to uncompressed regions of the insole. There is also a durability problem with these insoles caused by the wrinkling and shearing forces to which they are subjected.

In accordance with the present invention, it has been determined that the use of openings or apertures in the insole provides a ventilating effect as the wearer walks, compressing different parts of the insole. This ventilation keeps the foot from getting hot. In addition, the placement of the apertures provides improved flow patterns, including a slower, turbulent flow, evenly distributed around the apertures.

SUMMARY OF THE INVENTION

The improved insole of the present invention is formed from two super-imposed sheets of flexible, fluid-impervious material. Each sheet is generally in the shape of a foot and includes portions to underlie the ball, longitudinal arch and heel of the foot. There are openings passing through both sheets, with the sheets being sealed together around the openings to form apertures through the entire innersole structure. In addition, the sheets are sealed together near the edges thereof to form an enclosure between the sheets capable of holding a fluid.

Various types of ventilating openings are embraced by the concept of the invention. One type is an aperture with the sheets sealed together with a crimping immediately around the aperture. In another type, the sheets are sealed together in a relatively smooth area surrounding an aperture, with crimping surrounding the smooth area. In yet another type, the sheets are sealed together along an elongated strip with slit openings in the strip and spaced along a portion of the length of it.

In another embodiment of the invention, a foam layer is disposed between the sheets of the insole to significantly control the flow of fluid therein. This embodiment can also be provided with ventilating openings passing through the sheets and the foam material.

The openings in the insole produce a ventilating effect as the wearer walks, compressing different parts of the insole. They also control the flow of fluid in the insole by impeding flow in certain paths. Thus, the placement of openings along selected lines on the insole provides a desired compartmentalization for the temporary accumulation of fluid in portions of the insole during walking, as the fluid is transported from one portion of the innersole to another portion. The various embodiments of the openings affect flow of the fluid differently, as will be described in more detail below. Improvements in the flow of the fluid are also effected by the use of a layer of foam material in one embodiment.

The sealing around the openings, and along lines and strips serve to stabilize the shape of the sole during walking. An additional structural factor of considerable importance in such an insole is its durability. The regions where the sheets are sealed together are points of high stress. The embodiments disclosed allow ventilatory openings through the insole, while remaining quite durable.

These and other advantages and features of the invention will become apparent from a consideration of the description of the preferred embodiments which follows.

DESCRIPTION OF THE PREFERRED EMBODIMENT

Figure 1:
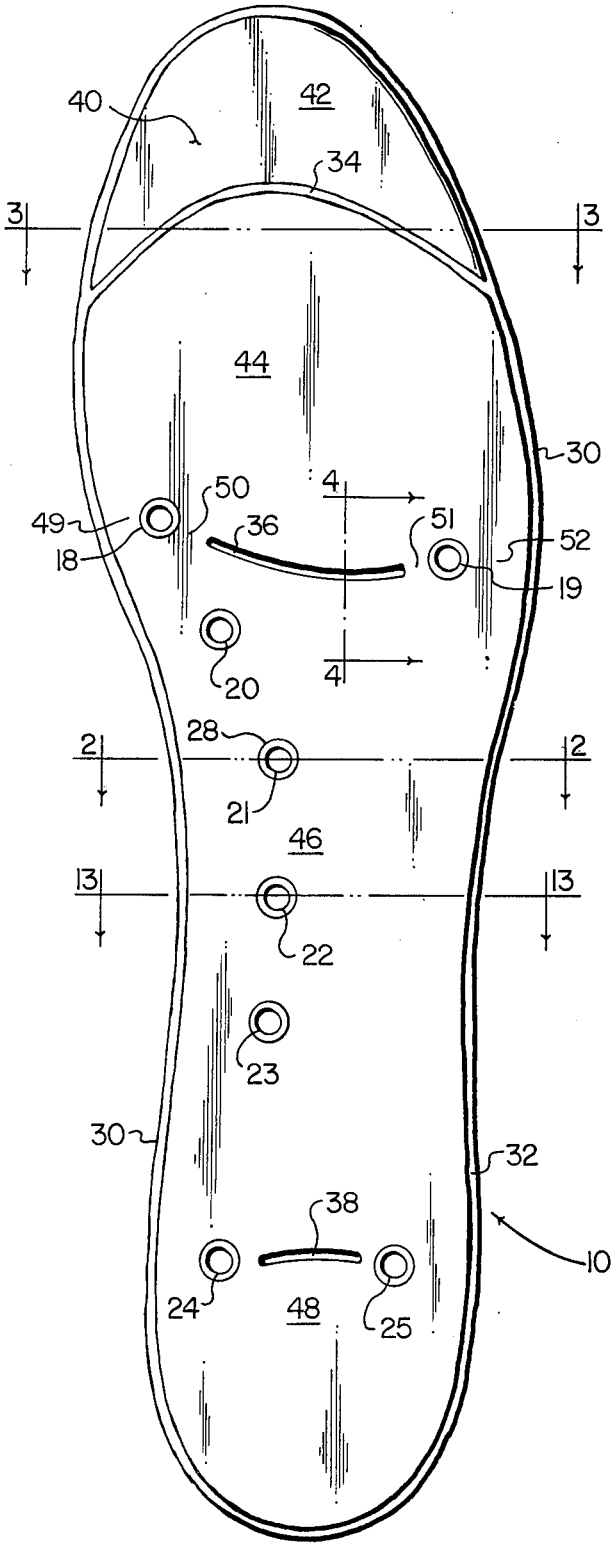
FIG. 1 is a plan view of an insole according to the invention.

FIGS. 1–4 illustrate an insole according to the invention, indicated generally by the reference numeral 10. As can be particularly seen in FIGS. 2 and 3, the insole 10 is constructed of two sheets 12 and 14 enclosing a fluid 16. The sheets 12 and 14 are of the shape seen in FIG. 1, which is generally the shape of a foot or a common shoe sole. Sheets 12 and 14 are cut from a soft, flexible fluid impervious sheet material such as 0.015 inch thick vinyl.

The sheets 12 and 14 have ventilating openings or apertures 18–25 at selected locations therein. Aperture 21 is seen in cross-section in FIG. 2. The sheets 12 and 14 are sealed together immediately around apertures 18–25. Such sealing can be by any known means to provide a fluid tight seal. Examples of such sealing techniques are heat sealing, solvent sealing and the like. This forms a pinched or crimped section around each aperture, like section 28 seen around aperture 21 in FIGS. 1 and 2. The pinched or crimped section serves as a fluid tight seal about the aperture.

Figure 2:
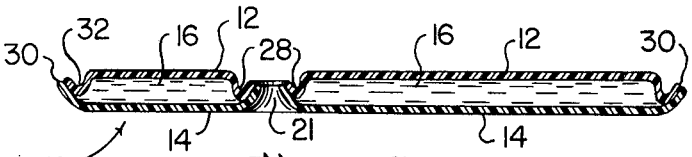
FIG. 2 is a cross-section taken along the section line 2 in FIG. 1.
Figure 3:
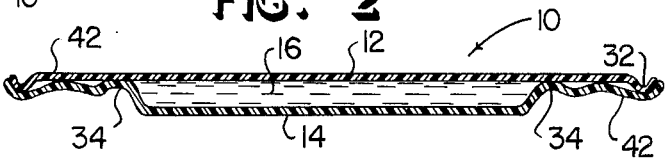
FIG. 3 is a cross-section taken along the section line 3 in FIG. 1.
Figure 4:
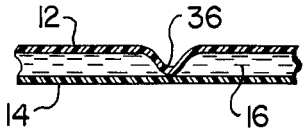
FIG. 4 is a partial cross-section taken along the section line 4 in FIG. 1.

The sheets 12 and 14 are likewise sealed together at the edges 30 thereof, forming the crimped section 32 seen in FIGS. 1–3 to form a fluid tight seal. In addition, the two sheets are sealed together along lines 34, 36 and 38. The sealing along line 36 is from a position near aperture 18 to a position near aperture 19. The line 38 seal extends from near aperture 24 to near aperture 25. Parts of the sealing along line 34 can be seen in FIG. 3 while a cross-section of that along line 36 is seen in FIG. 4.

In fabricating the insole 10, the sheets 12 and 14 are cut, then sealed such as by heat sealing together at the edges 30, around the apertures 18–25 and along lines 36 and 38. A hypodermic syringe pierces one of the sheets 12 or 14 at a location above line 34, such as site 40 and a measured amount of fluid is injected into the volume between the sheets and below line 34; then the instrument used to inject the fluid is withdrawn. The amount of the fluid inserted varies over a considerable range; in a preferred embodiment, a 15 to 60 ml quantity is used, depending on the foot size of the insole. The fluid, which can be water, is allowed to collect toward the heel of the insole while the sheets 12 and 14 are sealed together along line 34. Thus, the portion 42 above line 34 in FIG. 1 does not contain fluid. As a result, portion 42, additionally illustrated in FIG. 3, remains relatively flat regardless of the motion of fluid in other portions of the insole.

Insole 10 is designed to massage the foot of the wearer, while he is walking. When one part of the foot presses down, fluid is squeezed into other parts of the insole. If the flow is arranged properly, the fluid accumulates beneath other parts of the foot which will be cushioned and massaged when they press down.

The flow and collection of fluid in the insole 10 is controlled by the placement of the apertures 18–25 and the seals along lines 36–38. One of the regions where fluid is to collect is the portion 44 of the insole underlying the ball of the foot. Apertures 18 and 19 and line 36 lie on a transverse line approximately along the rear of the ball portion 44. Apertures 20, 21, 22 and 23 lie on a longitudinal line in a portion 46 of the insole underlying the longitudinal arch of the foot. Apertures 24 and 25 and line 38 are on a transverse line in a portion 48 underlying the heel of the foot.

The primary role of the apertures 18–25 in the insole 10 is to provide ventilation between the foot and the underside of the insole. The primary function of the sealed lines 36 and 38 is to control the flow of fluid in the insole. The sealing of the sheets along line 36 prevents fluid from flowing across line 36 when the ball of the foot pushes down on portion 44 of the insole. Instead, the fluid must flow through unsealed regions 49, 50, 51 and 52. This restricts the speed with which the fluid can flow out of portion 44 during the compression of sheets 12 and 14 due to the weight of the user. Part of the restriction of the flow is due to the presence of the sealed apertures 18 and 19. Fluid can leave portion 44, but at a restricted rate, so that a cushioning and massaging of the foot is produced. Similarly, the sealing of the sheets 12 and 14 on line 38, along with the apertures 24 and 25 restrict the outflow of fluid from heel portion 48, during the compression of sheets 12 and 14 due to the weight of the wearer.

Figure 5:
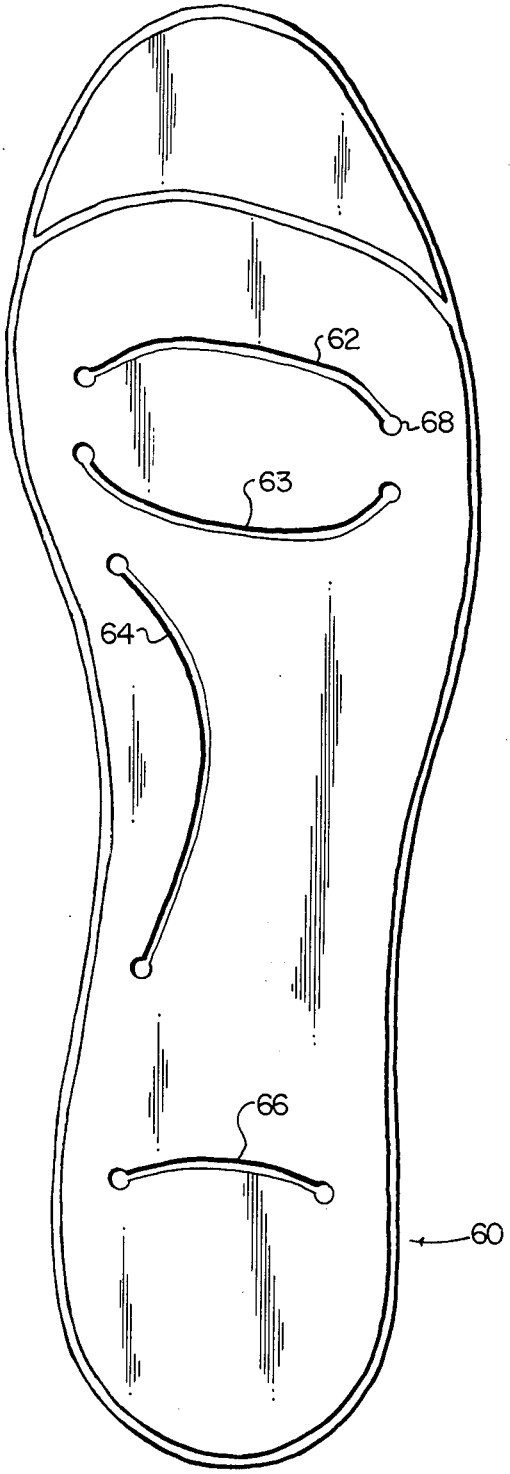
FIG. 5 (PRIOR ART)
FIG. 5 is a plan view of a prior art insole.

FIG. 5 shows a fluid filled insole according to the prior art, indicated generally by the reference numeral 60. Insole 60 has a seal along a line 62 in the portion underlying the ball of the foot, as well as a line 63 along the rear of the ball portion. A sealed line 64 underlies the longitudinal arch of the foot. A seal along line 66 is in the heel portion of the insole 60. The seals along lines 62, 63, 64 and 66 control the flow of a fluid within insole 60 in ways similar to the line seals and holes of insole 10. Insole 60 does not have any openings through it, like the present invention. The round parts 68 of the seal lines of insole 60 are simply terminating parts of the sealed section along the lines such as line 62. As a result, insole 60 does not produce the ventilating effect provided by the present invention. Additionally, insole 60 does not have a series of discreet sealed apertures as in the instant invention and all of the fluid contained in insole 60 is channeled through the insole at high velocities as it rushes through the unrestricted spaces between the long sealed lines and the outer edges. On the other hand, the instant invention provides for a more restricted and even flow of fluid as it flows around the individual sealed walls of apertures 18–25. Such restricted flow gives a more even stimulation to the foot of the wearer.

Figure 7:
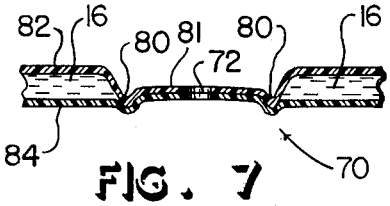
FIG. 7 is a cross-section taken along section line 7 in FIG. 6.
Figure 6:
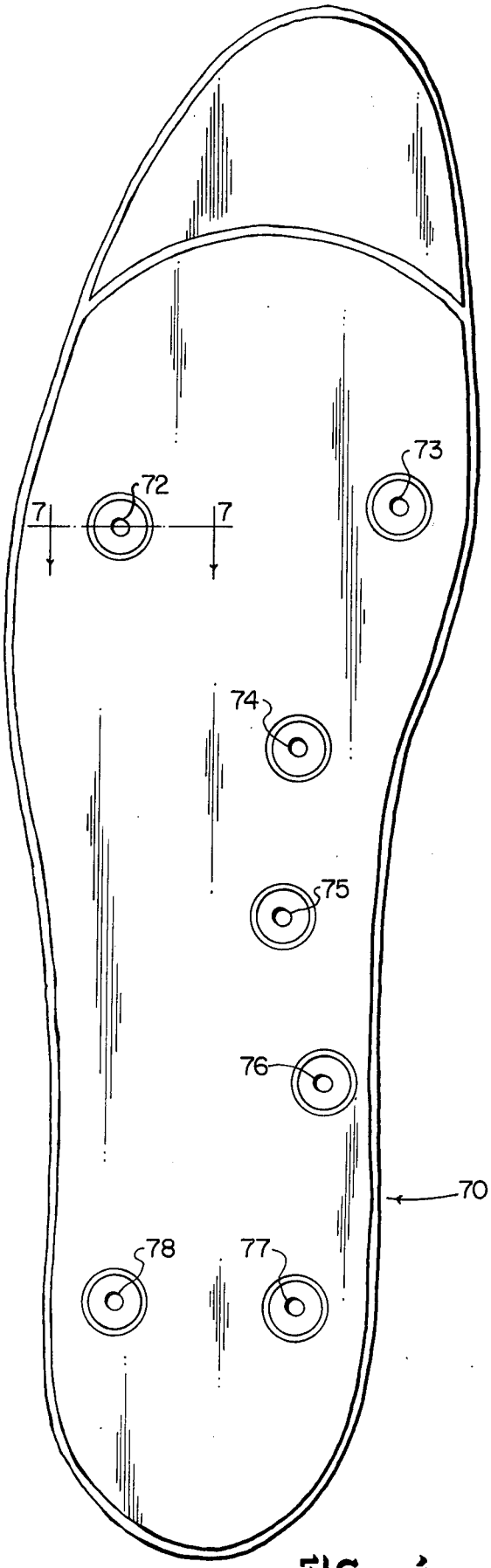
FIG. 6 is a plan view of an insole according to a second embodiment of the invention.

FIG. 6 illustrates another embodiment of an insole according to the invention, indicated generally by the reference numeral 70. Insole 70 has apertures 72–78 in positions generally similar to those of the apertures in insole 10. However as seen in FIG. 7, the structure of the insole around the apertures of insole 70 is different. The two sheets 82 and 84 forming insole 70 are heat sealed together forming a ridged section 80 at some distance from the edges of the aperture 72. Between the aperture and the ridged section is a smooth section 81. This is in contrast to the structure surrounding aperture 21 in FIG. 2. As in FIG. 1, there are apertures 72 and 73 lying on a transverse line in the ball portion of the insoles 70 and apertures 77 and 78 lying on a transverse line in the heel portion of the insole. Apertures 74, 75 and 76 extend along the longitudinal arch portion of the insole.

One effect of the larger diameter of the ridge section 80 is to block fluid flow over a larger area. Thus, the apertures are rendered more influential in the role of restricting and directing the flow of fluid to certain pathways in the insole. The sealing around apertures 72–78 has enhanced durability compared to that around apertures 18–25 in FIG. 1, largely because the sheets of the insole are sealed together over a larger area around the apertures 72–78.

Figure 8:
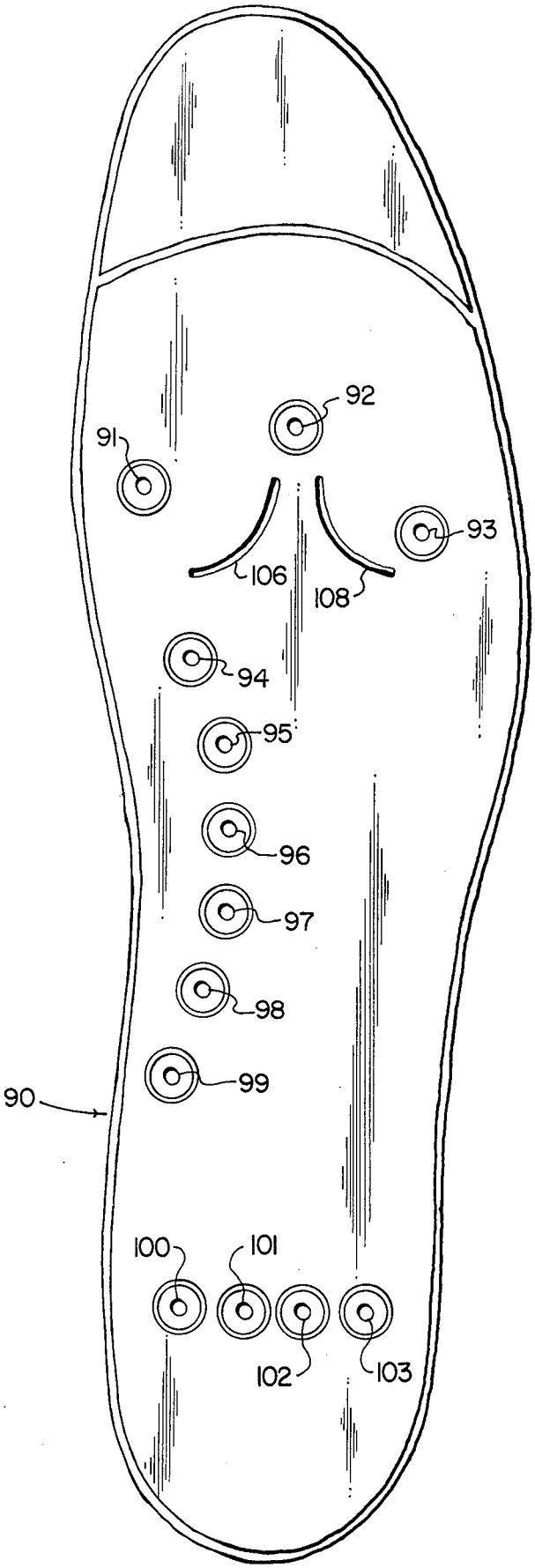
FIG. 8 is a plan view of an insole according to a third embodiment of the invention.

FIG. 8 illustrates yet another embodiment of an insole according to the invention, indicated generally by the reference numeral 90. The apertures therein, 91–103 are of the same construction illustrated in FIGS. 6 and 7. Apertures 94–99 in the longitudinal arch portion of the insole 90 are more numerous than corresponding apertures 74–76 in insole 70. There are also more apertures 100–103 in the heel portion. The greater number of apertures provides greater restriction of flow through the area occupied by the apertures and by the sealing around them; it also provides more ventilation. An additional aperture 92 is included in the ball portion of insole 90, roughly midway between apertures 91 and 93 therein. As with insole 10, there are line-type seals in the rear part of the ball portion of the insole. One line 106 extends from behind aperture 91 to a position behind aperture 92. A second line 108 extends from behind aperture 93 to a position behind aperture 92. As with insole 10, lines 106 and 108 restrict and direct the flow of fluid from the ball portion of the insole during its compression.

Figure 9:
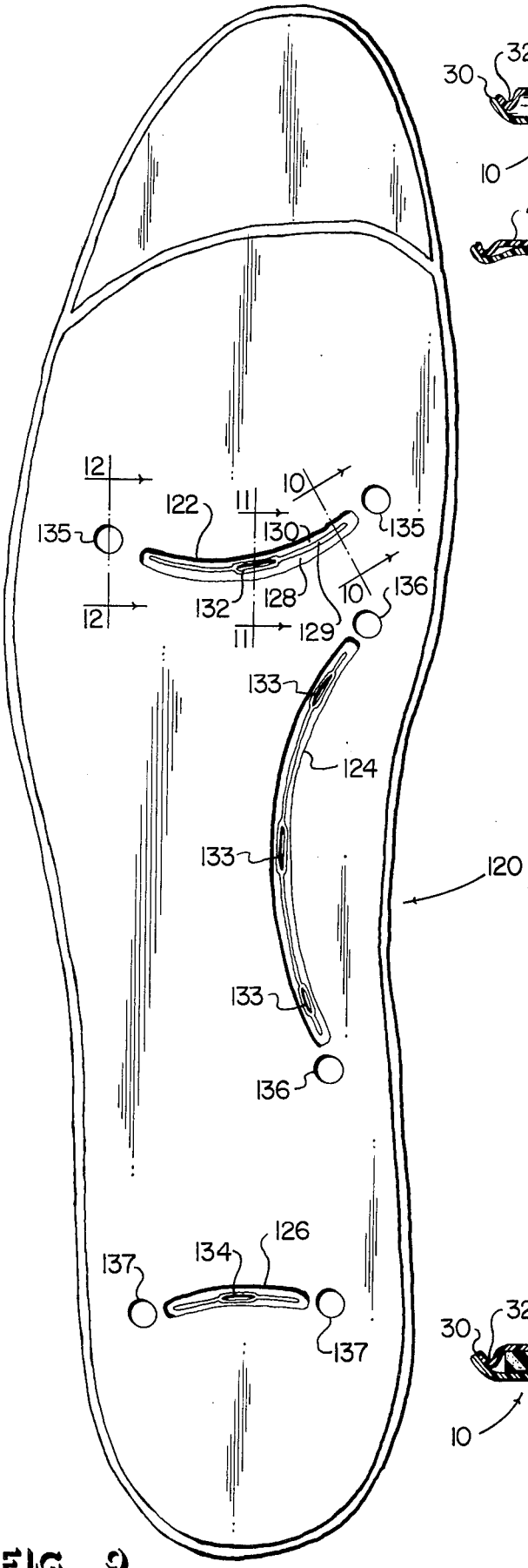
FIG. 9 is a plan view of an insole according to a fourth embodiment of the invention.

FIG. 9 illustrates yet another embodiment of an insole according to the invention, indicated generally by the reference numeral 120. The sheets forming the insole 120 are sealed together along strips 122, 124 and 126 which are wider than the seals along lines 106 and 108 in insole 90 (FIG. 8) or along lines 62, 63, 64 and 66 of insole 60 (FIG. 5). Strips 122 and 126 lie transversely across the ball and heel portions of the sole 120 respectively, while strip 124 lies longitudinally in the longitudinal arch portion of the insole.

Figure 10:
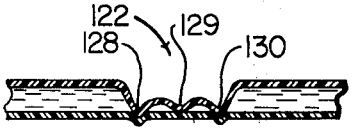
FIG. 10 is a cross-section taken along the section line 10 in FIG. 9.
Figure 11:
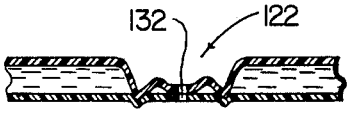
FIG. 11 is a cross-section taken along the section line 11 in FIG. 9.

As seen in FIG. 10, the sealed strip 122 throughout part of its length has three ridge sections 128, 129 and 130 formed therein. FIG. 11 is a cross-section through an opening or slit 132 along a part of the ridge section 129. The other sealed strips 123 and 124, which are of the same construction as 122, also have slits 133 and 134 therein.

Figure 12:
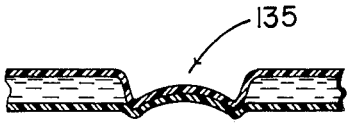
FIG. 12 is a cross-section taken along the section line 12 in FIG. 9.

At each end of the strips 122, 124 and 126, there are sealed circular sections like spot 135. As illustrated in the cross-section of FIG. 12 the spot 135 is not an aperture but simply a sealed area. At the ends of strips 124 and 126 are sealed spots 136 and 137 respectively.

Sealed strips 122, 124 and 126 restrict the flow of fluid in the insole 120 as described in connection with lines 36 and 38 and apertures 18–25 of insole 10 in FIG. 1. The sealed circular sections 135, 136 and 137 at the ends of the sealed strips act as reinforcements for the end portions of the strips and also serve to restrict and direct flow of fluid within the insole structure. Slits 132, 133 and 134 provide ventilation between the foot and the underside of insole 120. In this respect then they perform the function of holes 18–25 in insole 10 (FIG. 1).

Figure 13:
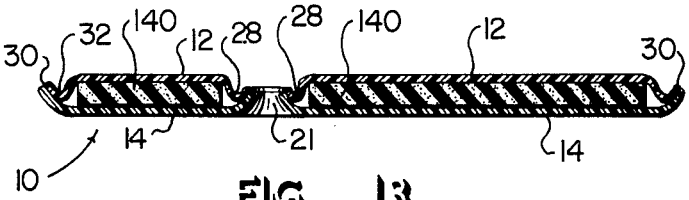
FIG. 13 is a cross-section taken along the section line 13 in FIG. 1.

FIG. 13 is a view, similar to FIG. 2, of an embodiment wherein a layer 140 of foamed polymeric material is inserted between the vinyl sheets 12 and 14. Such a layer of foamed material can be used not only with insole 10, but any of the insoles 70, 90 or 120. Indeed, the foamed material may be used independently of holes through the insole. In sole 10, the foam material would be between sheets 12 and 14 and cut to fit between the crimped section 32 at the edges 30 of the sheets. The foamed material can be, for example, foamed polybutadiene, foamed butadiene-styrene copolymer, foamed natural rubber and the like. In the insole 10, the seals around holes 18–25 and on lines 36 and 38 would be made through the foam. Fluid in the insole is dispersed throughout the foamed material 140. The presence of the material 140 additionally restricts the flow of the fluid so that an enhanced massaging and cushioning effect results.

The "fluid" that has been discussed above as being used to fill at least a portion of the insole structure is preferably liquid that can be contained within the sealed chamber of the insole that is formed by sealing at least the peripheral edges of the overlying sheets together. It is within the scope of this invention to utilize a fluid system that is a two-phase fluid such as a mixture of a liquid and a gas. In fact, the presence of a liquid and a gas have produced some additional advantages in that the gas phase is a compressible phase while the liquid phase is noncompressible. Thus the weight of the user on the insole structure that contains at least some gas phase fluid will cause compression of the gas, thereby giving additional cushioning and massaging action as the fluid moves about in the structure.

Any type of liquid material or gaseous material can be used in the structure, so long as it can be contained by the structure and so long as it has sufficiently low viscosity to allow it to move within the structure. For example, water alone or in combination with other liquid materials is quite useful as fluid for use in this invention. Other liquids such as glycol, alcohols, low viscosity oils and the like can also be used. If desired, the fluids can be colored to enhance the appearance of the structure, especially if the membranes making up the structure are transparent.

Scented materials such as deodorants, perfumes and the like can be incorporated into the fluid system whereby the odors of such can permeate the membranes making up the structure.

Although preferred embodiments of the invention have been described in detail, it is to be understood that various changes, substitutions and alterations can be made therein, without departing from the spirit and scope of the invention as defined by the appended claims.

I claim:

1. An insole of a shoe comprising two super-imposed sheets of flexible, fluid-impervious material, each sheet being generally in the shape of a foot and including portions to underlie the ball, longitudinal arch and heel of the foot, with a plurality of openings passing through both sheets, said sheets being sealed together along a perimeter generally near the edges of the sheets, and sealed together around said openings, to form an enclosure between said sheets capable of holding a fluid, said enclosure being at least partially filled with a relatively incompressable liquid, with a plurality of said openings being arranged along a curved line so as to form a border of said longitudinal arch portion, thereby to direct flow of said liquid with respect to the longitudinal arch portion, said openings further providing ventilation through the insole.

2. The insole of claim 1, wherein said openings are substantially round apertures having an area of sealing around each aperture, including a section crimped along a perimeter around the aperture.

3. The insole of claim 2, wherein said area of sealing further includes a relatively smooth section around the aperture, surrounded by said crimped section.

4. The insole of claim 1, further including foam material occupying a substantial part of said enclosure.

5. The insole of claim 1, wherein said enclosure contains a scented fluid.

6. The insole of claim 1, wherein said enclosure contains a colored fluid.

7. The insole of claim 1, wherein each of said sheets has a plurality of said openings in each of said portions.

8. The insole of claim 1, wherein each of said sheets includes a plurality of openings lying along a transverse line on the ball portion of the sheet, a plurality of openings lying on a longitudinal line along said arch portion, and a plurality of openings lying on a transverse line in said heel portion.

9. The insole of claim 1, wherein each of said ball and heel portions has a region thereof to the right and a region thereof to the left, and said sheets have at least one of said openings passing through each sheet in each of said regions of the ball and heel portions, and said sheets have a plurality of openings lying on a longitudinal line along said arch portion.

10. The insole of claim 9, wherein said sheets are sealed together along a line extending from a position near the opening in one of said ball portion regions to a position near said opening in the other ball portion regions, and said sheets are sealed together along a line extending from a position near the opening in one of said heel portion regions to a position near said opening in the other heel portion region.

11. The insole of claim 10, wherein the ball portion includes an opening approximately midway between and forward of said openings in the left and right sections of the ball portion, and said sheets are sealed together in the ball portion along lines including a line extending from behind said left section opening to a position behind said midway opening and a line extending from behind said right section opening to a position behind said midway opening.

12. The insole of claim 1, wherein said sheets are sealed together along at least one elongated strip, and wherein at least one of said openings is a slit within the strip.

13. An insole of a shoe comprising two superimposed sheets of flexible, fluid-impervious material, each sheet being generally in the shape of a foot and including portions to underlie the ball, longitudinal arch and heel of the foot, with a plurality of openings passing through both sheets, said sheets being sealed together along a perimeter generally near the edges of the sheets, and sealed together around said openings, to form an enclosure between said sheets capable of holding a fluid, said enclosure being at least partially filled with a liquid, each of said openings being surrounded by a crimped sealing section and including a relatively smooth section between the crimped section and the opening, said openings providing ventilation through the insole and controlling the flow of said liquid.

* * * * *